United States Patent [19]

Robinson

[11] 4,366,411

[45] Dec. 28, 1982

[54] ELECTRIC FILAMENT LAMPS

[75] Inventor: Kenneth B. Robinson, Leicester, England

[73] Assignee: Thorn Electrical Industries Limited, London, England

[21] Appl. No.: 155,930

[22] Filed: Jun. 3, 1980

[30] Foreign Application Priority Data

Jun. 5, 1979 [GB] United Kingdom ..... 7919539

[51] Int. Cl.[3] ..... H01J 1/88; H01J 19/42; H01K 1/18

[52] U.S. Cl. ..... 313/272; 313/273; 313/278

[58] Field of Search ..... 313/271, 272, 273, 278

[56] References Cited

U.S. PATENT DOCUMENTS

| | | | |
|---|---|---|---|
| 2,824,995 | 2/1958 | Kirk | 313/271 |
| 3,440,473 | 4/1969 | Smith et al. | 313/272 |
| 3,497,752 | 2/1970 | Peterson | 313/271 |
| 3,986,067 | 10/1976 | De Fraeye | 313/273 |
| 4,023,060 | 5/1977 | Pike et al. | 313/273 |

FOREIGN PATENT DOCUMENTS

| | | | |
|---|---|---|---|
| 912679 | 9/1961 | United Kingdom | 313/273 |
| 1168604 | 4/1968 | United Kingdom | 313/273 |

*Primary Examiner*—Saxfield Chatmon, Jr.
*Attorney, Agent, or Firm*—Robert F. O'Connell

[57] ABSTRACT

A quartz iodine studio lamp has a tungsten filament (32) formed of several sections (34) arranged in a plane between two quartz bridges (16,18) which are in turn supported by support wires (20,22). One end of the filament assembly (14) is supported in a seal (28) forming one end of the envelope (12). To stabilize the filament assembly, so as to stop it hitting the envelope wall, two spring coils (40) are carried by the bridge (16) remote from the seal (28) and extend transversely of the envelope to its inner surface.

12 Claims, 3 Drawing Figures

ELECTRIC FILAMENT LAMPS

This invention relates to electric filament lamps, particularly of large size such as used in studio lamps. The invention is of particular relevance to lamps which operate on the halogen cycle, e.g. quartz-iodine lamps.

The invention is concerned with lamps of the type having an envelope, and a filament assembly within the envelope and comprising two spaced substantially parallel bridge members supported by support members and a filament having filament sections supported between the bridge members, the filament assembly being fixed relative to the envelope at an end of the assembly adjacent one of the bridge members.

With such lamps, particularly when of large size, there may be a considerable flexing movement of the mount or filament assembly within the bulb or envelope. If the lamp is subjected to a mechanical shock, this could result in the filament assembly impinging on the envelope wall, possibly either causing cracking of the envelope or smashing the filament assembly.

Various prior proposals have been made to give added stability to the filament assembly. These have not proved very satisfactory, either because they can break or become displaced, or because they require expensive manufacturing techniques.

There are particular problems in the stabilising of lamps which operate on the halogen cycle as only compatible materials, e.g. tungsten, can be used in the lamp.

This invention provides an improved electric filament lamp as defined in the appended claims to which reference should now be made.

The invention will be described in more detail, by way of example, with reference to the drawing, in which.

Figure 1:
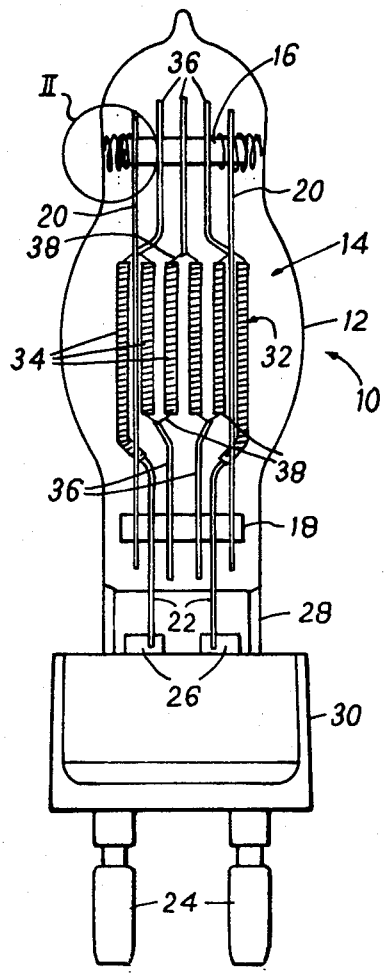
FIG. 1 is an elevational view of an electric filament lamp embodying the invention.

The lamp 10 illustrated is a 5 kilowatt quartz halogen studio lamp having a generally cylindrical quartz envelope 12 and a filament assembly 14 within the envelope. The filament assembly 14 comprises two insulating quartz bridges 16 and 18 in spaced parallel arrangement and orientated transversely of the cylindrical envelope 12. The bridges are supported by support wires, of which two wires 20 extend between the bridges 16,18, and two wires 22 extend between the lower bridge 18 as shown in FIG. 1 and the lower end of the envelope 12. These two wires 22 also supply current to the filament and are connected to external pins 24 by seal conductors 26 of conventional construction which pass through the lamp seal 28. The lamp seal is received within a lamp base member 30.

The lamp filament 32 is of tungsten and is supported within the envelope 12 between the bridges 16,18 and has a plurality of, in this case six, sections 34 which extend generally longitudinally of the lamp. The sections 34 lie at least approximately in a common plane, namely the plane of the paper in FIG. 1, and are supported by the two above-mentioned support wires 22 which contact the two ends of the filament, and by further support wires 36 which extend respectively from the bridges 16 and 18 to bights 38 between the filament sections.

In the manufacture of the lamp, the completed filament assembly 14, after being heat treated to turn the tungsten filament from the fibrous to the required crystalline form, is positioned within the envelope 12 with the top and bottom ends of the envelope open. The seal 28 is formed in the bottom end. The envelope is then evacuated with the top end forming the exhaust aperture, and the top end then sealed.

As thus-far described the lamp is of known construction. However, it will be appreciated that the filament assembly 14 is supported at its lowermost end as seen in FIG. 1, so that in the absence of further preventative measures the upper end of the filament assembly would be prone to undesired flexing movement, particularly if the lamp is subjected to any mechanical shock.

In accordance with this invention the upper bridge 16, which is of tubular shape, carries at each end a spring coil 40. In the example shown the coil is of tungsten wire which is screwed onto the bridge 16 and is locked around one of the support wires 20 by mechanical deformation of the pitch of the coil. The spring coils 40 are added to the mount after it has been heat treated. Thus the tungsten of the coils 40 remains in the more flexible fibrous form, and is not converted into the more fragile crystalline form. The coil length is chosen to be either a clearance fit (as shown) or a slight spring fit in the envelope 12.

Figure 3:
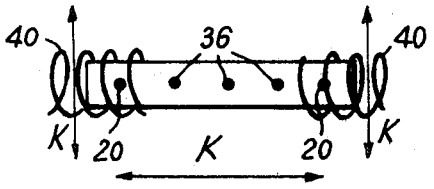
FIG. 3 is a partial plan view of the upper bridge.

The spring coils 40 provide flexibility transversely of the envelope in the plane of the filament and perpendicular to it, as indicated by the arrows K in FIG. 3. This gives a slower deceleration to the filament assembly, under shock conditions, than would occur if the filament assembly were to hit the side of the envelope, thus reducing the G forces on the brittle tungsten components of the filament assembly 14. Since the coils 40 are in sliding contact with the envelope wall, expansion of the filament assembly is permitted without distortion.

The use of coil springs has the advantage that the deflection which has to be accommodated is applied over a considerable length of flexible tungsten wire, so that they can withstand considerable deflection without breakage or permanent deformation, the bending movements applied to the coils being very low.

Figure 2:
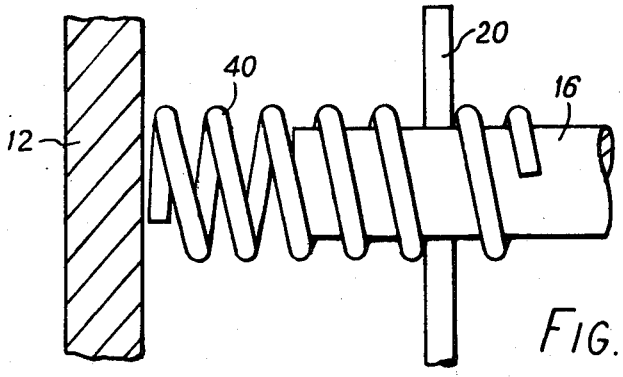
FIG. 2 shows a detail of the construction of the lamp of FIG. 1 as shown within the circle II on FIG. 1.

In the illustrated example, the coil was of about 6 mm diameter and made of tungsten wire of 0.025 inch (about 0.63 mm) diameter. About five active turns of wire were used, as shown in FIG. 2. Because of the complex factors which determine the spring requirements, in practice appropriate coil parameters can be determined empirically, such that the deflections in the maximum shock conditions which the lamp is to withstand do not lead to the filament assembly contacting the envelope, but are large enough to reduce the G forces applied, even at operating temperatures and after ageing.

I claim:

1. An electric filament lamp, comprising:

an envelope defined by a lamp wall;

a filament assembly within said envelope, said filament assembly comprising:

two spaced substantially parallel bridge members;

support members supporting said bridge members; and a filament having filament sections supported between said bridge members;

said filament assembly being fixed relative to said envelope at an end of said assembly adjacent a first one of said bridge members;

wherein the improvement consists in:

wire coils fixed to the ends of the second one of said bridge members, said wire coils extending substantially transversely of said filament assembly outwardly towards the lamp wall to sustain end loads axially of the coil and thereby stabilize said filament assembly.

2. A lamp according to claim 1, in which the bridge member carrying the coils is tubular.

3. A lamp according to claim 1, in which the coils are screwed onto the ends of the bridge member.

4. A lamp according to claim 2, in which the coils are screwed onto the ends of the bridge member.

5. A lamp according to claim 1 in which the coils are permitted to slide along the inner wall of the envelope to relieve longitudinal expansion of the filament assembly.

6. A lamp according to claim 1, in which the lamp operates on the halogen cycle, and the coils are made of tungsten.

7. A lamp according to claim 1, in which the coils are a slight clearance or spring fit within the envelope.

8. A lamp according to claim 1 in which there is one coil at each end of said second bridge member arranged with the coil axes aligned with the axis of the bridge members.

9. An electric filament lamp including:

(a) an envelope defined by a lamp wall;

(b) a filament assembly within the envelope, wherein the filament assembly includes:

(i) two spaced substantially parallel bridge members;

(ii) support members joining and supporting said bridge members;

(iii) a filament having a plurality of filament sections; and (iv) means for supporting said filament sections between the bridge members;

(c) means for fixing said filament assembly relative to said envelope at an end of said assembly adjacent a first one of said bridge members; and (d) a plurality of wire coils fixed to the ends of the second one of the bridge members and extending towards said lamp wall with the axes of the coils substantially normal to the lamp wall thereby to stabilize said filament assembly by absorbing motion of the filament assembly towards the lamp wall in compression thereof.

10. An electric filament lamp according to claim 9 in which there is one wire coil at each end of said second bridge member.

11. An electric filament lamp including:

(a) an envelope defined by a lamp wall;

(b) two spaced substantially parallel insulating bridge members;

(c) a plurality of support members joining and supporting said bridge members;

(d) a filament having a plurality of filament sections:

(e) means for supporting said filament sections between the bridge members;

(f) a lamp seal whereby electrical conductors enter said envelope to supply current to the filament;

(g) further support members extending between one of said bridges and the lamp seal to fix the filament relative to the envelope;

(h) two wire coils, disposed one at each end of the other bridge member, axially aligned therewith, and extending towards the lamp wall with their axes normal thereto, to absorb in compression excessive motion of the said other bridge member towards the lamp wall and thereby stabilize the filament in shock conditions.

12. A lamp according to claim 11 in which the further support members comprise electrical conductors for carrying current between the seal and the filament.

* * * * *

UNITED STATES PATENT AND TRADEMARK OFFICE

CERTIFICATE OF CORRECTION

PATENT NO. : 4,366,411

DATED : December 28, 1982

INVENTOR(S) : Kenneth Buckley Robinson

It is certified that error appears in the above-identified patent and that said Letters Patent are hereby corrected as shown below:

On the Title Page, Item [73], please change the Assignee to --THORN EMI LIMITED--

Signed and Sealed this

*Twelfth* Day of *July 1983*

[SEAL]

*Attest:*

GERALD J. MOSSINGHOFF

*Attesting Officer*

*Commissioner of Patents and Trademarks*